United States Patent [19]

Saunders

[11] Patent Number: 5,061,008

[45] Date of Patent: Oct. 29, 1991

[54] FIXTURE FOR ARROW NOCK AND FLETCHING ORIENTATION

[75] Inventor: Charles A. Saunders, Columbus, Nebr.

[73] Assignee: Saunders Archery Company, Columbus, Nebr.

[21] Appl. No.: 447,883

[22] Filed: Dec. 8, 1989

[51] Int. Cl.[5] ..... B25B 1/20

[52] U.S. Cl. ..... 269/38

[58] Field of Search ..... 269/38, 296; 273/423, 273/420, 416; 29/1.2; 124/41.1, 1

[56] References Cited

U.S. PATENT DOCUMENTS

| | | | |
|---|---|---|---|
| 2,731,992 | 1/1956 | Lozon | 273/423 X |
| 3,108,792 | 10/1963 | Martin | 269/38 |
| 3,333,842 | 8/1967 | Bitzenburger | 269/38 |
| 3,338,772 | 8/1967 | McWherter | 269/38 X |
| 4,623,410 | 11/1986 | Hillesheim et al. | 269/38 X |
| 4,749,175 | 6/1988 | Grabits | 269/38 |

*Primary Examiner*—Peter M. Cuomo

*Attorney, Agent, or Firm*—Michael G. Berkman

[57] ABSTRACT

A fixture for archery use, and the method of using the fixture for selectively and reproducibly positioning and orienting an arrow nock to be attached to the shaft of a fletched arrow. The fixture includes frame-carried elements for supporting a lineal section of an arrow shaft. An annularly adjustable, frame-mounted sleeve telescopingly receives, in keying relation therewith, a slotted end of an arrow nock. A nock-engaging end zone of a fletching-carrying shaft of an arrow, precoated with an adhesive, is inserted axially to seat contiguously within the sleeve, whereupon the arrow shaft is rotated to bring a reference fletching of the arrow shaft into alignment correlation with a rod-like guide pointer which overlies the frame-supported shaft.

6 Claims, 2 Drawing Sheets

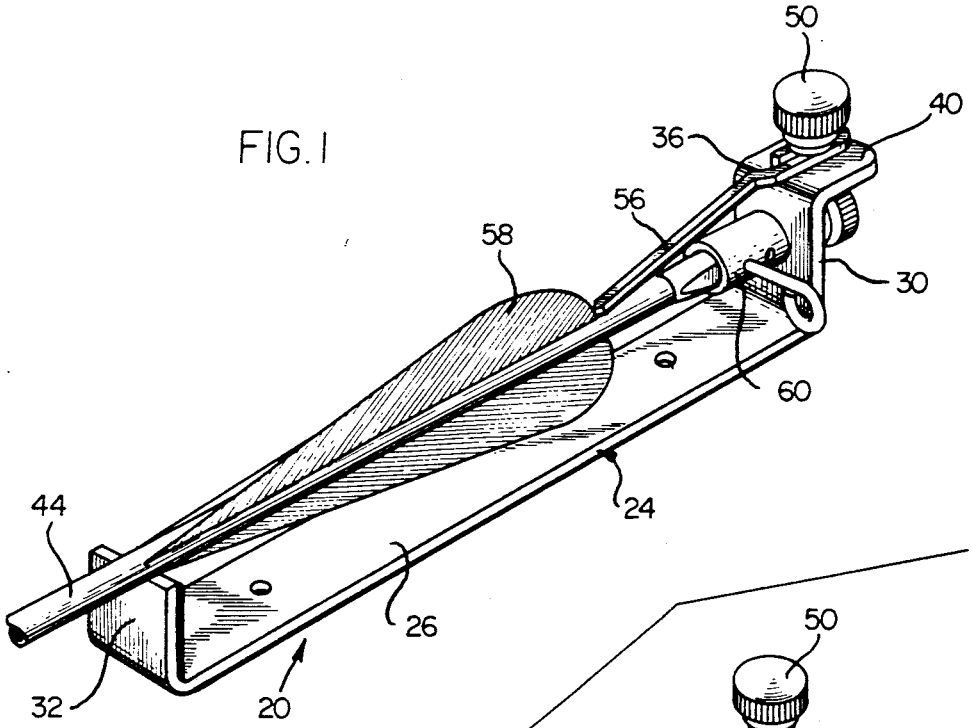
FIG. 1
50
40
36
56
58
30
60
24
44
26
32
20
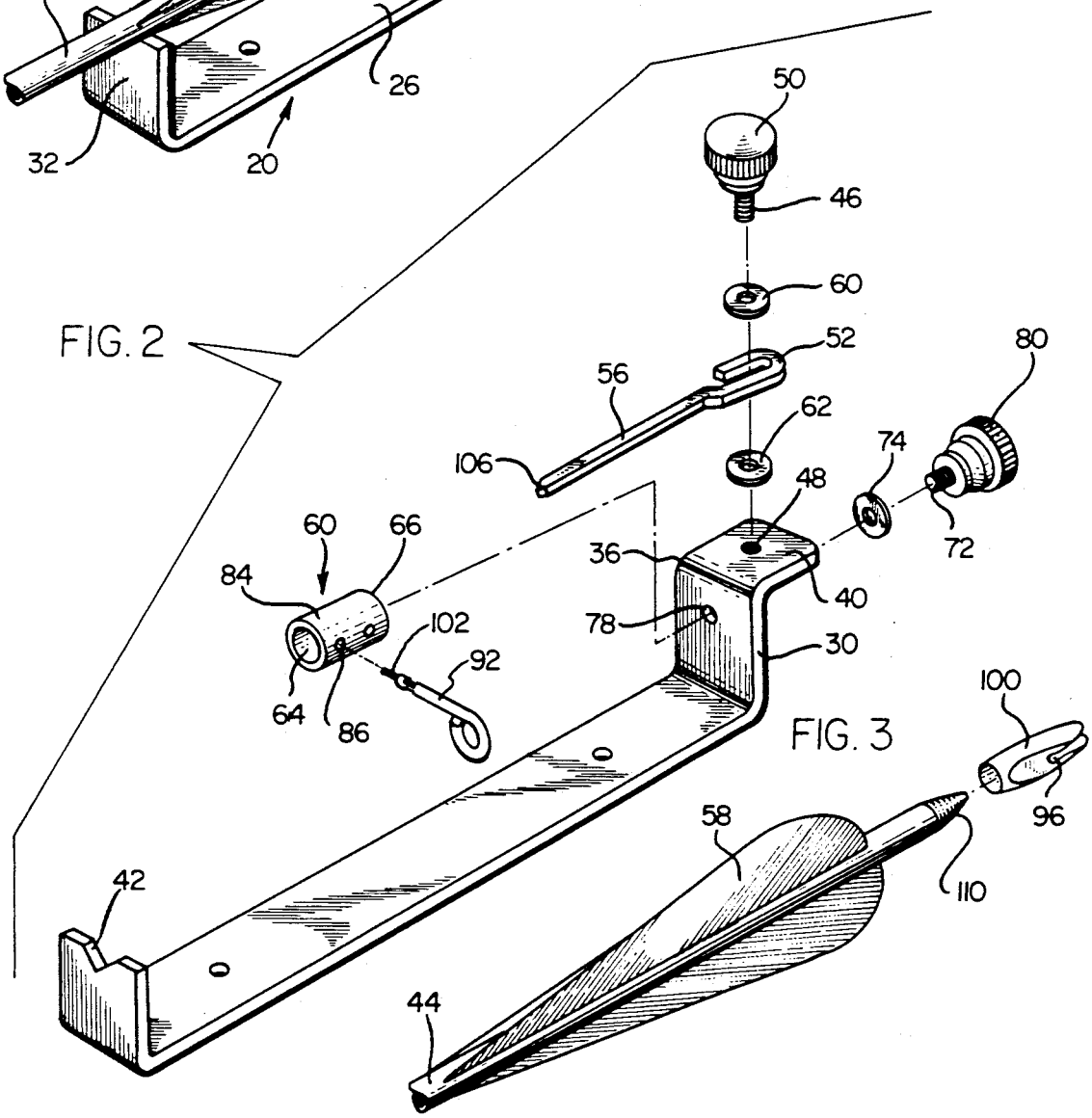
FIG. 2
50
46
60
52
56
62
106
80
74
48
72
60
66
36
40
84
78
102
30
92
64
86
42
FIG. 3
100
96
58
110
44

FIXTURE FOR ARROW NOCK AND FLETCHING ORIENTATION

The present invention relates to a fixture, jig, or adjustable guide for archery applications. More particularly, the invention is directed to a fixture and to its method of use enabling one selectively and reproducibly to attach ann arrow nock to an arrow shaft so as to establish a preferred selective orientational relationship between the string-receiving slot of the nock and a reference fletching on the arrow shaft.

A proper or an individually preferred configurational relationship or precise spatial arrangement between the bowstring-receiving slot of the arrow nock and the fletching feathers or vanes of an arrow shaft is, or is perceived to be, dependent, to some extent, on personal or subjective criteria. Such criteria may vary somewhat from archer-to-archer, although, in each case, the ultimate aim is to assure a true arrow flight course from arrow release to target.

While many archers find prefabricated and preassembled, commercially-available nocked arrows quite acceptable for their needs, others prefer to make some definitive adjustments to provide a final structure better suited to their own, individual styles or techniques.

It will be appreciated that when an archer has, through trial and error, or otherwise, found what he or she perceives as an optimum spatial relationship and orientation of the nock slot and the lead (guide, reference, or outside) feather or fletch, it is important that the physical arrangement be readily and reliably reproducible, from assembly to assembly so that sought-for precision may be achievable and objectionable and unpredictable variability be eliminated.

It is a principal aim of the present invention to provide a simple yet highly reliable and versatile jig or fixture ensuring not only ease of adjustment but also constancy in configurational orientation. Through the use of the present invention, arrow nocks and arrow shafts may be repeatedly assembled, from arrow-to-arrow, without causing significant variation in the values of arrow-flight parameters such as relative rotational angles of nock slots and arrow shaft fletchings, which control or affect true arrow flight.

SUMMARY OF THE INVENTION

The present invention describes an adjustable fixture, clamp or jig for selectively and reproducibly positioning and securing an arrow nock on an arrow shaft. The apparatus and method are effective to establish a predetermined annular relative orientational configuration between the bowstring-receiving slot in the arrow nock and a reference or lead fletching on the arrow shaft.

In a preferred embodiment of the invention the fixture includes a frame-carried, sleeve-like socket for accepting the nock, endwise. A keying or aligning pin penetrates the slot in the nock radially, orients the nock annularly, and restrains the nock in the socket against rotation relative to the socket. The socket itself is rotatable about its longitudinal axis and is selectively securable in any preferred annular orientational mode.

A related feature of the fixture of the invention is the provision of a series of through holes in the wall of the nock-receiving sleeve for accommodating nocks having slots of varying depth and socket penetration.

Another feature of the fixture of the invention is a rod-like pointer fastened to the fixture to overlie the shaft of the arrow for establishing an aligning registry with a reference fletching attached to the arrow shaft.

Yet another feature of the invention is that the fixture includes means for adjusting the pointer, longitudinally, and for locking the pointer at any selectable position within the adjustment range.

Other practical advantages of the fixture of the invention are that it is versatile for use with many different kinds of arrows, that it is of sturdy construction and that it is simple to use.

Other and further objects, features and advantages of the invention will be evident from the following more detailed description of the invention considered in conjunction with the drawings.

BRIEF DESCRIPTION OF THE DRAWINGS

FIG. 1 is a perspective view of a fixture, according to the present invention, for orienting and for attaching an arrow nock on an arrow shaft, and showing the fletching vane of the arrow aligned with the reference pointer of the fixture;

FIG. 2 is an exploded view of the assembly depicted in FIG. 1;

FIG. 3 shows that portion of an arrow shaft to which a nock is to be attached;

DETAILED DESCRIPTION OF THE ILLUSTRATED EMBODIMENT

Figure 4:
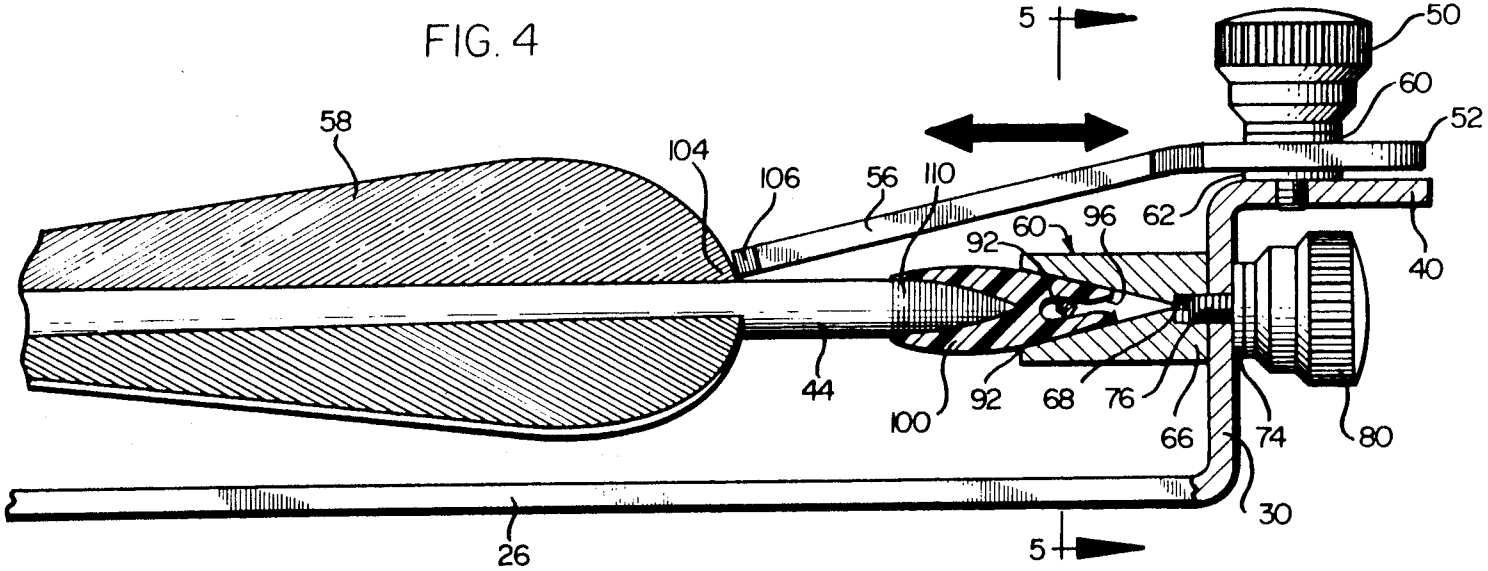
FIG. 4 is a side elevational view, with portions in section, showing the annularly-adjustable, nock-securing component of the fixture of the invention, and the longitudinally shiftable vane alignment pointer rod, each fastened on the frame of the fixture.

The aims and objects of the present invention are realized through the use of a simple, versatile and easily operable and manipulable device for accurately and reproducibly positioning an arrow nock on the shaft of an arrow and orienting the nock with respect to a reference or lead fletching on the arrow shaft. The drawings depict a particular embodiment of the invention, for illustrative purposes only, and not in any limiting sense.

Referring more particularly to the drawings, the assembly or fixture 20 of the invention is shown in FIGS. 1 and 2 as including a frame 24 having an elongate base 26 integrally formed at each of its opposed ends with upstanding arms 30 and 32. One of the arms 30 is bent rearwardly at its upstanding free end 36 to form a horizontal flange 40. The other arm 32 is cut out at its upper end to form a V-rest 42 for an arrow shaft 44.

A bolt 46 threadedly engaged in a tapped bore 48 formed in the flange 40 is surmounted by a knurled control knob 50. A looped end 52 of an elongated pointer or rod 56, disposed between a pair of washers 60 and 62 captive on the threaded bolt 46 brackets the bolt 46 and is adjustable and slideable transversely of a principal axis of the bolt 46.

The knurled knob 50 may be turned to bring compressive pressure on opposed upper and lower faces of the loop end 52 of the pointer 56 to secure the latter in a selectable forward or rearward position along the base 26 of the frame 24 for alignment of a lead feather or vane 58.

As shown in FIGS. 1 and 4, a generally tubular nock-receiving sleeve 60 is open at one end 64 and has a rear plate 66, which has a threaded opening 68. A screw 72 threadedly coupled to the sleeve at the plate 66, passes through a washer 74 and the threaded bore 68 in the frame arm 30 and is fastened to and capped by a knurled locking nut 80. Tightening of the nut 80 brings the base plate 66 of the sleeve 60 into frictionally locking abutment against the frame arm 30 to secure the nock-receiving sleeve 60 in place.

Figure 5:
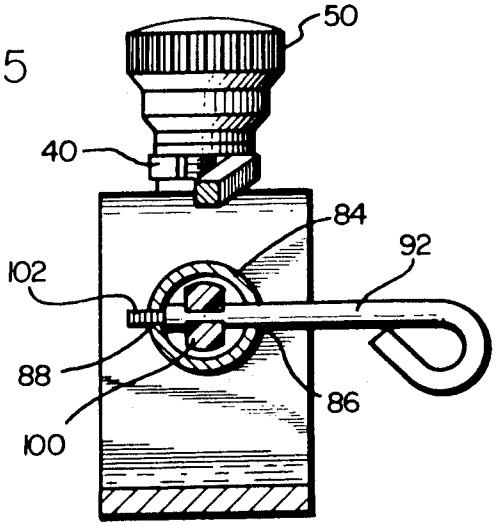
FIG. 5 is a cross-sectional view taken substantially on the lines 5—5 of FIG. 4.

In the specific embodiment of the fixture illustrated, and as shown in FIG. 5, the cylindrical wall 84 of the sleeve 60 is formed with a pair of diametrically opposed openings 86 and 88 for accommodating a keying pin 92 for seating in the string-receiving slot 96 at the end portion of the arrow nock 100 to orient and to fix the nock 100 against rotational displacement in the sleeve 60 of the fixture 20.

Preferably, a series of such cooperating hole pairs, arranged lineally along the length of the sleeve 60, are provided for nocks of different dimensions, lengths, or sleeve penetration. While the keying pin 92 may be pressed forcibly into and frictionally retained in any selectably opposed in-line pair of sleeve holes, in the preferred embodiment of the fixture 20 shown, a smaller hole 88, of each hole pair, is tapped to provide threads for engagement with cooperating mating threads 102 at a lineal end zone of the keying pin 92. The keying pin 92 also serves as a finger gripped means to hold the sleeve 60 fixed in any desired annular disposition, while one tightens the locking nut 80 to fix the sleeve 60 in place.

Figure 6:
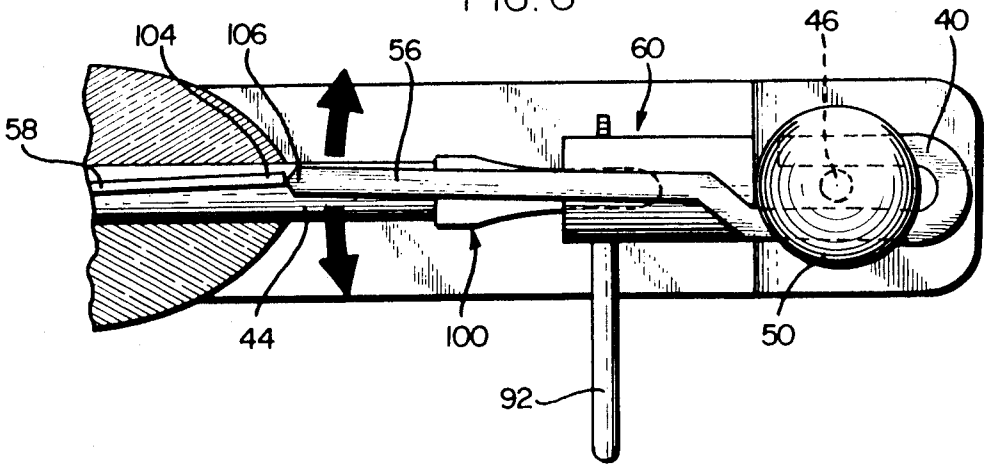
FIG. 6 is a top plan view of the fixture of the invention, with the arrow nock and shaft in place and indicating schematically the lateral positioning capability of the reference pointer.

One method of using the fixture of the invention is described below with reference to FIGS. 4, 5 and 6. Assuming, for example, that an archer wishes to attach an arrow nock 100 to the end of an arrow shaft 44 and in doing so be able later to duplicate the rotational or annular orientation of the nock 100 with respect to the position of a reference fletching 58 on the shaft 44 of the arrow being "copied". As a first step, the reference arrow or arrow being "duplicated" is placed on the fixture 20, with the nock 100 inserted into the sleeve 60 and the slot 96 of the nock 100 keyed with the keying pin 92. With this achieved and with the body of the arrow shaft 44 resting in the V rest 42, and with the pointer 56 extending along a center line of the shaft 44, the sleeve 60 is loosened and the arrow shaft 44 then rotated to bring a lagging or rearward terminal edge 104 of the lead feather or vane 58 into alignment with the extending end 106 of the pointer 56. The knurled locking nut 80 is then tightened to lock the nock-receiving sleeve 60 in the established setting.

To duplicate precisely the arrow nock 100 and fletching 58 orientation in a "new" arrow, one inserts the nock 100 into the sleeve 60 with the nock slot 96 keyed with the keying pin 92. The rear end zone 110 of the arrow shaft 44, to which an adhesive composition (not shown) has first been applied, is inserted telescopically into the nock 100 keyingly held in the sleeve 60, to seat in the nock 100, and the arrow shaft 44 is lowered into a rest position in the V-slot 42 at the forward end of the fixture 20. The shaft 44 of the arrow is rotated axially to bring the rear extremity 104 of the lead feather or vane 58 into registry alignment with the end 106 of the pointer rod 56. When the adhesive bond between the end 110 of the arrow 44 and the enveloping nock 100 is sufficiently firm, the arrow is carefully removed from the fixture 2 and the adhesive permitted fully to cure.

What is claimed is:

1. A fixture for selectively and reproducibly positioning and orienting an arrow nock for securement of a shaft of a fletched arrow, said fixture comprising frame means including an elongate base and arm means for supporting a linear section of an overlying arrow shaft carried thereby, generally tubular, sleeve-like, nock-securing, open ended socket means carried by said base at one end thereof, said socket means being adapted to receive a slotted end portion of an arrow nock projecting axially therewithin;

adjustable means for restraining the arrow nock in said socket means against annular rotation with respect thereto, rod-like guide pointer means extending generally along and overlying the shaft of an arrow carried on said frame means, and means for releasibly locking said pointer means on said frame means against rotation in a plane generally paralleling a plane of the arrow shaft, and for securing said pointer means in a selectable positional attitude overlying the shaft of an arrow carried on said frame means, said pointer means delineating a reference alignment and correspondence with an arrow-shaft-mounted vane for facilitating establishment of a repeatedly reproducible orientational registry with the vane on the shaft of an arrow supported on said frame means.

2. The structure as set forth in claim 1 and further comprising means for rotating said socket means and for securing said socket means and said means for restraining the arrow nock against annular rotation with respect to said socket means in a selectable arcuate orientation with reference to said fixture.

3. The structure as set forth in claim 1 wherein said means for restraining the nock against annular rotation with respect to said socket means comprise keying pin means extending through a bounding wall of said socket means and between spaced legs bounding an open-ended string-receiving slot formed in the arrow nock.

4. The structure as set forth in claim 1 wherein said socket means is formed with a through radial bore in a bounding tubular wall thereof, and further comprising pin means for extending diametrically through said bore for invading said socket means to pass through a slotted end portion of the arrow nock for keying the arrow nock with said sleeve-like socket means and restraining the arrow nock against annular rotation with respect to said socket means.

5. The structure as set forth in claim 4 and further comprising an array of through radial bores in said bounding wall of said socket means, the bores of said array being disposed at lineally spaced positions along a longitudinal expanse of said socket means, for accommodating arrow nocks having end slots of various lesser and greater depths.

6. The structure as set forth in claim 1 wherein said means for releasibly locking said guide pointer includes means for holding said pointer means in selectable positions of axial displacement longitudinally along the arrow shaft for accommodating arrows having vanes at various different axial locations along the arrow shaft, with respect to the arrow nock.

* * * * *